United States Patent [19]

Phelan

[11] Patent Number: 4,783,079

[45] Date of Patent: Nov. 8, 1988

[54] BOARD GAME

[76] Inventor: Randal S. Phelan, 17 Brentwood Cir., Lubbock, Tex. 79407

[21] Appl. No.: 11,528

[22] Filed: Feb. 6, 1987

[51] Int. Cl.[4] ..... A63F 3/00

[52] U.S. Cl. ..... 273/253; 273/255

[58] Field of Search ..... 273/243, 250, 253, 254, 273/255, 262, 271, 249, 236

[56] References Cited

U.S. PATENT DOCUMENTS

| | | | |
|---|---|---|---|
| 2,852,260 | 9/1958 | Caffrey | 273/249 |
| 4,092,029 | 5/1978 | Jones | 273/271 |
| 4,114,891 | 9/1978 | Lawrimore | 273/250 |
| 4,200,293 | 4/1980 | Benson, III | 273/260 |
| 4,385,765 | 5/1983 | Munn et al. | 273/253 |
| 4,534,567 | 8/1985 | Ferris et al. | 273/255 |

FOREIGN PATENT DOCUMENTS

| | | | |
|---|---|---|---|
| 512541 | 9/1939 | United Kingdom | 273/236 |

OTHER PUBLICATIONS

"Betelgeuse", Philip Zweig, Games Magazine, Feb. 1986, p. 50.

*Primary Examiner*—Richard C. Pinkham
*Assistant Examiner*—Benjamin Layno
*Attorney, Agent, or Firm*—Daniel V. Thompson

[57] ABSTRACT

A board game is provided in which a planar playing surface is defined by an array of hexagonal spaces. The hexagonal spaces are grouped together by color. There are twelve different colors, each representing a different "zone." The object of the game is to place as many "starships" as possible in a "zone" and thus, win the "zone". The player winning the most "zones" wins the game. The play is initiated by rolling a colored dodecahedron die and moving a playing piece counterclockwise around the board's perimeter to the color indicated on the die. The player then places the number of "starships" indicated on the corresponding "zone" in order to strategically control that "zone."

17 Claims, 1 Drawing Sheet

BOARD GAME

TECHNICAL FIELD

This invention relates to board games and more particularly to an outer space conquest board game.

BACKGROUND OF THE INVENTION

Science fiction, space travel and outer space warfare are subjects which have long interested both young and old alike. Books, movies and television have spawned many stimulating space game apparatuses and devices. Other space games include U.S. Pat. No. 4,200,293, April 29, 1980, to H. Benson, and U.S. Pat. No. 4,385,765, May 31, 1983, to Munn, et al.

The Benson patent uses "starships" but puts numerical values on their various sides to indicate the number of spaces for movement. Attacks are made by landing on an opposing "starship's" space or by attacking from an adjacent space.

The Munn patent utilizes a game board patterned after our solar system. The game employs various cards to create specific conditions prior to encounters between players. Encounters between players are determined by the roll of dice.

SUMMARY OF THE INVENTION

The present invention is comprised of a game board with a series of hexagonal spaces. The hexagonal spaces, called "sectors", are grouped into twelve different colors forming "zones." A border around the perimeter of the board has alternating groups of the twelve colors with random 'numbers on each color. One of four colored dodecahedron dice is used to determine what zone a player moves to. Four colored wheels with a space for each of the twelve colors is provided for ranking the colors on the dodecahedron dice during encounters with other players. Six "commanders , nine hundred "starships", and 100 "blue-holes" for placement on the "zones" complete the game pieces.

All "blue-holes" are initially positioned on appropriately marked "sectors" in the "zones." The game is initiated by one of the "commanders" moving to the nearest color on the perimeter indicated by the roll of a die. The "commander" then places the number of "starships," indicated on the colored perimeter space, on the "sectors" of the correspondingly colored "zone." The "commander's" objective is to place his/her "starships" strategically within the "zone" so as to be able to surround any "blue-holes" and/or opponent's "starships." Once a "blue-hole" and/or an opponent's "starship" is surrounded, those "starships" and/or "blue-holes" are replaced with the surrounding "commander's" "starships."

Encounters also occur between adjacent "starships" within the same "zone." The two "commanders" in the encounter each roll a die and the winner is determined by referring to a color wheel. Using the color of the "zone" in which the encounter occurs as the highest value, the colors on the wheel are decreasingly valued in a counter-clockwise direction. The "commander" rolling the highest valued color wins the encounter and replaces the loser with one of his/her "starships." An "encounter" with a "blue-hole" cannot take place.

The game continues until all "sectors" in all "zones" are filled. The "commander" having the most "starships" in a "zone" wins that "zone." The "commander" winning the most "zones" wins the game.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

For a more complete understanding of the present invention and for further advantages thereof, reference is now made to the following Description of the Preferred Embodiment taken in conjunction with the accompanying drawings, in which.

DESCRIPTION OF THE PREFERRED EMBODIMENT

Figure 1:
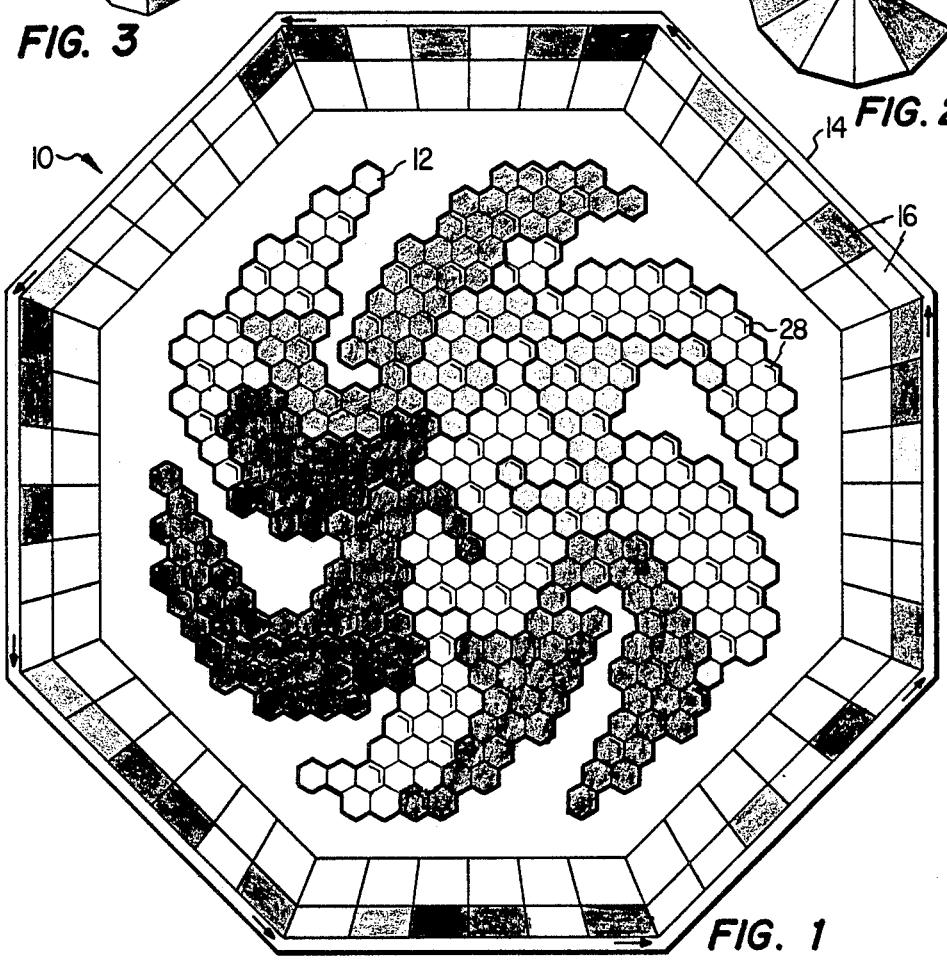
FIG. 1 is a top elevation view of the game board of the present invention.

Referring to FIG. 1, a planar game board is generally identified by the reference numeral 10. In the preferred embodiment planar game board 10 has an octagonal shape. Planar game board 10 has a playing surface made of an array of hexagonal spaces 12. The hexagonal spaces 12 are grouped together by color. In the preferred embodiment the number and color of spaces are: 49 lavender, 41 purple, 49 magenta, 28 pink, 27 red, 25 orange, 30 light orange, 21 beige, 24 yellow, 29 green, 32 lime, and 41 blue. The arrangement of the groups can be any design such as shown in FIG. 1 which resembles three letter "S's" swirled about a common center point.

There are a total of 100 "blue holes" 28 on the game board 10. In the preferred embodiment, "blue holes" 28 are distributed a follows: eleven in lavender, nine in purple, twelve in magenta, eight in pink, seven in red, eight in orange, nine in light orange, five in beige, six in yellow, seven in green, eight in lime and ten in blue.

Figure 4:
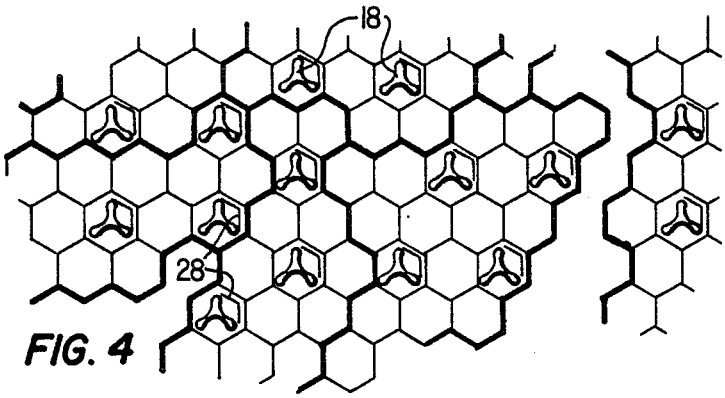
FIG. 4 is a top elevation view of a section of the game board showing borders between colors and playing pieces being positioned for play..

Around the outer perimeter 14 are generally rectangular spaces 16. Each rectangular space 16 (six rectangular spaces per each octagonal side) is one of the twelve colors listed above in a random order. Each rectangular space 16 is further marked with symbols to indicate how many playing pieces 18, FIG. 4, are to be placed on the hexagonal spaces 12 by a player.

Players can be symbolized by a player marker (up to six). There are one hundred fifty playing pieces 18 for each player. Playing pieces 18 can correspond by color and/or shape to the player markers.

Figure 2:
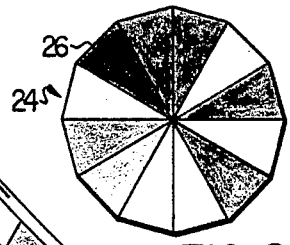
FIG. 2 is a top elevation view of the colored wheel of the present invention.

Four colored wheels 24, FIG. 2, are provided. Wheels 24 are divided into twelve sections 26. Each section 26 is one of the twelve different colors as listed above.

Figure 3:
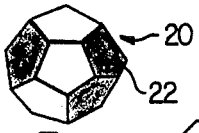
FIG. 3 is a top elevation view of a die used with the present invention.

Four dodecahedron dice 20, FIG. 3, are provided. Each side 22 of the die 20 is one of the twelve different colors as listed above.

Play is initiated by each player rolling a die 20. The player rolling the highest ranked color is the first to begin. The first player again rolls a die 20 and moves his player marker counterclockwise to the nearest rectangular space 16 on the outer perimeter 14 that is the same color as his roll indicates. The player then places the number of playing pieces 18 on the same color hexagonal spaces 12 as are indicated on the rectangular space 16. The game proceeds to the next counterclockwise player who follows the same procedure as the first player.

The object of the game is for each player to occupy as many hexagonal spaces 12 as possible in each zone. Hexagonal spaces 12 are won by encounters against opposing playing pieces 18 or by surrounding and then replacing opposing playing pieces 18. The player with the most hexagonal spaces per color wins that color. The player winning the most colors wins the game.

Although the present invention has been described with respect to a specific preferred embodiment thereof, various changes and modifications may be suggested to one skilled in the art and it is intended that the present invention encompass such changes and modifications as fall within the scope of the appended claims.

I claim:

1. A space conquest board game comprising:

a planar game board having an outer perimeter;

said game board having a plurality of playing spaces grouped together by color;

each of said game board groups having a unique color selected from a plurality of different colors;

said game board having additional spaces along said outer perimeter;

said outer perimeter spaces each being marked with one of said plurality of different colors in a randomly alternating pattern;

each of said outer perimeter spaces being further marked with one of a plurality of differing random numbers a plurality of playing markers to identify separate players;

a plurality of playing pieces for placement on said playing spaces corresponding to each of said playing markers;

said random numbers used to indicate how many of said playing pieces are to be placed on said playing spaces;

playing dice having the same number of sides and colors corresponding to said plurality of different colors; and color wheels divided into the same number of colors corresponding to said plurality of different colors.

2. The space conquest board game of claim 1, wherein said outer perimeter forms an octagon.

3. The space conquest board game of claim 1, wherein said playing spaces are hexagonal.

4. The space conquest board game of claim 1, wherein said plurality of different color groups numbers twelve.

5. The space conquest board game of claim 1, wherein said plurality of playing markers is six.

6. The space conquest board game of claim 1, wherein said plurality of playing pieces is one hundred fifty for each of said playing markers.

7. The space conquest board game of claim 1, wherein said plurality of playing spaces grouped together by color comprise:

thirty-five spaces of lavender;
forty-one spaces of purple;
forty-nine spaces of magenta;
twenty-eight spaces of pink;
twenty-seven spaces of red;
twenty-five spaces of orange;
thirty spaces of light orange;
twenty-one spaces of beige;
twenty-four spaces of yellow;
twenty-nine spaces of green;
thirty-two spaces of lime; and
forty-one spaces of blue.

8. The space conquest board game of claim 7, wherein said plurality of playing spaces are further marked with one hundred blue holes as follows:

eleven of the lavender spaces;
nine of the purple spaces;
twelve of the magenta spaces;
eight of the pink spaces;
seven of the red spaces;
eight of the orange spaces;
nine of the light orange spaces;
five of the beige spaces;
six of the yellow spaces;
seven of the green spaces;
eight of the lime spaces; and
ten of the blue spaces.

9. A space conquest board game comprising:

a planar game board having an outer perimeter;

said game board having a plurality of playing spaces grouped together by color;

each of said game board groups having a unique color selected from a plurality of different colors;

said game board having additional spaces along said outer perimeter;

said outer perimeter spaces each being marked with one of said plurality of different colors in a randomly alternating pattern;

each of said outer perimeter spaces being further marked with one of a plurality of differing random numbers;

playing markers to identify up to six separate players;

one hundred fifty playing pieces corresponding to each of said playing markers for placement on said playing spaces;

one hundred blue holes marked on selected ones of said playing spaces;

said random numbers being used to indicate how many of said playing pieces are to be placed on said playing spaces;

playing dice having the same number of sides and colors corresponding to said plurality of different colors; and color wheels divided into the same number of colors corresponding to said plurality of different colors.

10. The space conquest board game of claim 9, wherein said outer perimeter forms an octagon.

11. The space conquest board game of claim 9, wherein said playing spaces are hexagonal.

12. The space conquest board game of claim 9, wherein said plurality of different color groups numbers twelve.

13. The space conquest board game of claim 9, wherein said plurality of playing spaces grouped together by color comprise:

thirty-five spaces of lavender;
forty-one spaces of purple;
forty-nine spaces of magenta;
twenty-eight spaces of pink;
twenty-seven spaces of red;
twenty-five spaces of orange;
thirty spaces of light orange;
twenty-one spaces of beige;
twenty-four spaces of yellow;
twenty-nine spaces of green;
thirty-two spaces of lime; and forty-one spaces of blue.

14. The space conquest board game of claim 9, wherein said one hundred blue holes are marked on said selected spaces as follows:

eleven of the lavender spaces;
nine of the purple spaces;
twelve of the magenta spaces;
eight of the pink spaces;
seven of the red spaces;
eight of the orange spaces;
nine of the light orange spaces;
five of the beige spaces;
six of the yellow spaces;
seven of the green spaces;
eight of the lime spaces; and
ten of the blue spaces.

15. A space conquest board game comprising:

a planar game board having an octagonal outer perimeter;

said game board having a plurality of hexagonal spaces grouped together by color;

each of said game board groups having a unique color selected from twelve different colors;

said game board having generally rectangular shaped spaces along said outer perimeter, said rectangular spaces being marked with one of said twelve different colors in a randomly alternating pattern;

each of said rectangular spaces being further marked with on a a plurality of differing random numbers;

playing markers to identify up to six separate players;

one hundred fifty playing pieces corresponding to each of said playing markers for placement on said hexagonal spaces;

one hundred blue holes marked on selected ones of said hexagonal spaces;

said random numbers being used to indicate how many of said playing pieces are to be placed on said playing spaces;

four dodecahedron dice, each side having a color corresponding to one of said twelve different colors; and four color wheels divided into sections corresponding to each of said twelve different colors.

16. The space conquest board game of claim 15, wherein said plurality of hexagonal spaces grouped together by color comprise:

thirty-five spaces of lavender;
forty-one spaces of purple;
forty-nine spaces of magenta;
twenty-eight spaces of pink;
twenty-seven spaces of red;
twenty-five spaces of orange;
thirty spaces of light orange;
twenty-one spaces of beige;
twenty-four spaces of yellow;
twenty-nine spaces of green;
thirty-two spaces of lime; and
forty-one spaces of blue.

17. The space conquest board game of claim 15, wherein said one hundred blue holes are marked on said selected spaces as follows:

eleven of the lavender spaces;
nine of the purple spaces;
twelve of the magenta spaces;
eight of the pink spaces;
seven of the red spaces;
eight of the orange spaces;
nine of the light orange spaces;
five of the beige spaces;
six of the yellow spaces;
seven of the green spaces;
eight of the lime spaces; and
ten of the blue spaces.

* * * * *